US007174946B2

(12) United States Patent
Weber et al.

(10) Patent No.: US 7,174,946 B2
(45) Date of Patent: Feb. 13, 2007

(54) CHILL CASTING PROCESS AND FOAM CASTING PROCESS AS WELL AS A PRESSURE TIGHT CLOSABLE CASTING MOLD FOR MANUFACTURE OF FORM PARTS

(75) Inventors: Jochen Weber, Hannover (DE); Friedrich-Wilhelm Bach, Isemhagen (DE); Mirko Schaper, Hannover (DE)

(73) Assignee: The University of Hannover, Hannover (DE)

( * ) Notice: Subject to any disclaimer, the term of this patent is extended or adjusted under 35 U.S.C. 154(b) by 0 days.

(21) Appl. No.: 10/858,466

(22) Filed: Jun. 2, 2004

(65) Prior Publication Data

US 2005/0034836 A1 Feb. 17, 2005

(30) Foreign Application Priority Data

May 28, 2003 (EP) ..... 03012037

(51) Int. Cl.
*B22D 18/04* (2006.01)

(52) U.S. Cl. ..... 164/119; 164/79

(58) Field of Classification Search ..... 164/79, 164/119

See application file for complete search history.

(56) References Cited

U.S. PATENT DOCUMENTS 6,840,301 B2 * 1/2005 Nichol et al. ..... 164/79

FOREIGN PATENT DOCUMENTS

| | | | |
|---|---|---|---|
| DE | 2644272 | | 4/1977 |
| DE | 3209575 | A1 | 11/1982 |
| DE | 4326982 | C1 | 2/1995 |
| DE | 10104340 | A1 | 8/2002 |
| EP | 1266973 | A2 | 6/2002 |
| WO | 03/015960 | A2 | 2/2003 |

* cited by examiner

*Primary Examiner*—Len Tran
(74) *Attorney, Agent, or Firm*—Crowell & Moring LLP

(57) ABSTRACT

A chill casting and foam casting method together with a casting mold that is closable in a pressure-tight manner for producing molded articles. To improve the chill casting method and the foam casting method so that the quality of the products produced is greatly increased and particularly homogeneous material properties are achieved, a gas is supplied to a melt which only partially fills a closed mold cavity until the inside pressure within the mold cavity exceeds the melting point pressure curve such that the melt suddenly solidifies. The solidification process takes place largely independently of location and is thus sudden, so that the instantaneous state of the melt is reflected in the resulting solidified article with virtually no change. This makes it possible to produce molded articles which have a uniform core distribution and meet high quality demands in a reliable and reproducible manner. A casting mold that can be closed in a pressure-tight manner for carrying out such methods has at least one inlet opening for the supply of a fluid, in particular an inert gas.

12 Claims, No Drawings

CHILL CASTING PROCESS AND FOAM CASTING PROCESS AS WELL AS A PRESSURE TIGHT CLOSABLE CASTING MOLD FOR MANUFACTURE OF FORM PARTS

This invention relates to a chill casting method and a foam casting method and a pressure tight sealable casting mold for production of moldings.

Chill casting methods, in particular die-casting methods as well as foam casting methods have already been the object of many practical and scientific investigations and developments.

In die casting, the metal is conveyed out of the casting chamber by a plunger at a high speed and under a high pressure into a permanent multipart metal die mold, where it rapidly solidifies due to the high dissipation of heat. The pressure is maintained during solidification. Voids and undercuts are eliminated by fixed or movable cores and/or sliders.

The chill casting method is a precision casting method, which makes it possible to manufacture cast parts with complex shapes that already approximate the final dimensions and with a high surface quality. Die-cast parts have an extremely good dimensional accuracy and have smooth, clean surfaces and edges that require very little mechanical machining.

Components made of aluminum or magnesium are manufactured almost exclusively by the chill casting method which is characterized by a variety of advantages for the production of cast parts having thin walls. However, there are limits to this manufacturing technique in terms of the procedure and the material when large-volume components having a complex geometry, e.g., a crankcase, are to be manufactured by casting. The structural design of the parts and very complex and expensive casting molds prevent the use of die casting for manufacturing such components made of magnesium in large-scale series today. The advantages of the sand casting technique include the great freedom in design, the high productivity and profitability as well as the use of recyclable molding materials.

The solidification process which is determined by the geometry has proven to be problematical with all the known casting methods, so that areas near the surface solidify first because of the increased dissipation of heat whereas melt is still present in the internal area. Therefore, pores and a porous core may form there. Therefore, pressure cast parts are preferably also subjected in general to a visual inspection on a random sample basis in the manufacturing process and preferably also to random testing of quality features.

Various technical casting methods for production of open-pore metallic materials, so-called foam casting methods, are already known from practice. The economic importance of such metal foams, in particular those made of aluminum and magnesium alloys, has increased significantly especially in the lightweight construction sector. Both melt metallurgical methods and powder metallurgical methods are used to produce metal foams.

With the known methods, it is possible to produce foams having closed pores or almost closed pores. Such a morphology is of interest for the mechanical properties and thus for structural applications, e.g., for lightweight components in automotive engineering. Functional applications, e.g., as heat exchangers, filters or sound absorbers require a predominately open-pore structure so that a fluid can penetrate into the foam or can pass through it.

Different methods are used in practice for the manufacture of metal foams.

According to a known method, a gas is supplied to the melt by means of a lance which is immersed in the melt. The molten material permeated by the gas is removed in the layers near the surface by means of a slider and then is cooled rapidly. In this way, slab-shaped semifinished products are produced in particular and then can be re-shaped to form different components.

It has proven to be a disadvantage that no special geometric shapes or moldings can be produced by this method, so the semifinished products thus obtained must be reworked in any case. The surface of the slab-shaped semifinished products is not smooth but instead has open pores. Furthermore, such semifinished products have an irregular pore distribution because of the slow cooling during solidification.

The methods of powder metallurgy are also known for the production of foamed metals; in these methods, conventional metal powders are blended by conventional means with small amounts of an expanding agent which is also in the form of a powder. This powder mixture is then compacted to form a solid precursor material having a low porosity. Taking into account the required process parameters, the result of the compaction process is a foamable precursor material or semifinished product which may be processed further by conventional reshaping techniques to form sheet metal, profiles, etc., if necessary. When enclosed in a mold, these semifinished products are heated to a softening temperature below their melting point, resulting in foaming of the propellant.

The restricted shaping options have proven to be a disadvantage here. In particular, very fine structures cannot be produced in this way. Furthermore the process is difficult to control. In practice, this results in particular in an uneven distribution of pores. The resulting reaction gases require additional safety precautions.

Another known method is recasting of fillers with metallic melts. After removing the fillers, the result is a spongy open-pore body having interconnected pores. Through the choice of the fillers, the density and pore morphology can be varied within wide limits. However the materials produced by this method still contain residues of fillers.

The object of this invention is to improve upon chill casting methods and foam casting methods so that the quality of the products produced by these methods is significantly improved. In particular, homogeneous material properties are to be achieved. Furthermore, a casting mold that can be sealed pressure-tight is to be created for performing such processes.

The first object is achieved according to this invention with a chill casting method according to the features of claim 1. The subclaims relate to especially expedient refinements of this invention.

Thus, according to this invention, a chill casting method is provided in which by means of a fluid, in particular a gas, the pressure is increased until exceeding the melting point pressure curve of the melt. Therefore, solidification of the melt is not initiated on the basis of a cooling process as in the state of the art but instead by an increase in the pressure of the fluid acting on the melt. Therefore, the solidification process proceeds largely independently of location and thus takes place suddenly so that the instantaneous condition of the melt is reflected with virtually no change in the solidified melt. The melt need not be completely molten to this end. The heat of melting may be dissipated after solidification at a uniform pressure until falling below the solidus line.

The other object is achieved according to this invention with a foam casting method such that a gas is supplied to a closed or sealed mold cavity which only partially fills up the mold cavity that is closed or sealed until the interior pressure inside the mold cavity exceeds the melting point pressure curve such that there is a sudden solidification of the melt. On the basis of the inflowing gas, the desired foaming is achieved at the same time so that the metal foam completely fills up the mold cavity and the pressure rises; when the melting point pressure curve for solidification of the melt, including the gas bubbles contained in it forming the pores, is exceeded, this leads to solidification. This process can be performed with little complexity and in a single operation. In addition, this allows the production of moldings, which also have a uniform pore distribution and thus meet high quality demands with no problem and in a reliably reproducible manner furthermore. Because of the ease with which the process can be controlled, no strict safety requirements are necessary and in particular it is possible to use both chill molds and lost-cast molding with corresponding supporting housings as the casting molds.

It has proven to be especially expedient if the solidified melt is cooled according to the melting point pressure curve so that renewed softening of the solidified melt is prevented in order to be able to manufacture the desired products with the shortest possible cooling phase and to prevent delays due to unnecessarily long cooling times.

In addition, it has proven to be especially promising if the volume flow of the inflowing gas is adjusted as a function of the desired material properties of the solidified melt. In this way the distribution of pores and/or the local density distribution can be reliably determined in advance and, for example, the total weight of the components produced in this way can be further reduced in comparison with the state of the art.

The volume flow may be supplied to different areas and controlled in different ways, whereby the volume flow may be controlled or regulated as a function of time in order to thereby be able to adjust the properties of the pores in addition to their distribution.

It is especially advantageous if a gas is used, in particular a protective gas, that is neutral with respect to reacting with the melt. This does not cause any fundamental changes in the original material properties so that in particular no chemical reaction of the gas with the melt occurs. This process can be controlled easily and can also be used for different materials.

The melt may contain all technically relevant metals and their alloys. However, it is especially promising if the melt contains magnesium and/or aluminum as an essential component.

In addition, it has proven to be particularly relevant to practice if a cavity in a component is filled by the foam casting method. In this way it is possible to significantly increase the load-bearing capacity, e.g., the dimensional stability and compressive strength inexpensively. The high thermal stability of the metal foam has proven to be a significant advantage. Opening[s] present on the component are used for gas supply while other openings are sealed in a pressure-tight manner. By means of suitable additives, components whose nature cannot withstand the solidification pressure can also be foamed in this way if the component is acted upon on the outside by means of a fluid or the gas thereof with a corresponding counterpressure and is protected by a mold.

In addition, an embodiment in which multiple components are joined together in a non-positive manner by the foam casting method has proven to be particularly expedient. This yields a high load-bearing capacity and a connection that is easy to implement and can be used in various areas in practice.

The additional object of the present invention to create a casting mold that can be sealed in a pressure-tight manner for performing such methods is implemented according to this invention by the fact that the casting mold has at least one inlet opening for the supply of a fluid. Therefore, essentially known casting molds are suitable for performing the inventive method with little effort. The fluid is used to increase the pressure in the interior of the sealed or closed mold to thereby implement an approximately isothermal solidification. This avoids the disadvantage of the cooling process in the slowly solidifying melts.

A refinement of this invention has proven especially advantageous when the casting mold for producing moldings by the foam casting method is equipped with multiple inlet openings for a gas to thereby implement a uniform flow through the melt to achieve a homogeneous metal melt.

According to an embodiment of this invention that is particularly relevant to actual practice, the inlet openings may be arranged at a distance from one another according to the desired density distribution of the molding to thereby be able to implement partially deviating properties of the molding.

In addition, according to another particularly advantageous refinement, individual openings of the inlet openings are optionally designed to be closable or they have an adjustable flow cross section to thereby be able to influence the volume flow in a suitable manner, e.g., as a function of time.

Embodiment[s] of the inventive casting mold in which the inlet openings are arranged on a bottom surface and/or wall surface are especially suitable to thereby be able to optionally implement the desired surface properties, in particular closed-pore or open-pore products.

The casting mold may be designed as a lost casting mold, but it has proven especially relevant to practice if the casting mold is designed to be closable for multiple uses.

In addition, according to an embodiment that promises to be particularly successful, the casting mold has a receptacle for securing an insert part, whereby the insert part has a higher melting point than the melt and is reliably joined to the metal foam part by refoaming. Such an insert part may be, for example, a flange or a threaded receptacle which permits easy assembly of the molding.

The invention claimed is:

1. A chill casting method comprising the steps of forming a melt in a pressure tight mold, and introducing a fluid into the sealed mold to increase the pressure until the melting point pressure curve of the melt is exceeded such that a sudden solidification of the melt occurs.

2. A chill casting method according to claim 1, wherein said fluid is a gas.

3. A foam casting method comprising the steps of forming a melt in a mold, said melt filling up only part of a closed mold cavity in said mold, and supplying a gas to said melt until the inside pressure within the mold cavity exceeds the melting point pressure curve such that a sudden solidification of the melt occurs.

4. A foam casting method according to claim 3, wherein the solidified melt is cooled according to the melting point pressure curve in such a way that renewed softening of the solidified melt is prevented.

5. A foam casting method according to claim 3, wherein the volume flow of the supplied gas is adjusted as a function of desired properties of the solidified melt.

6. A foam casting method according to claim 3, wherein said gas is a neutral gas with regard to reacting with the melt.

7. A foam casting method according to claim 6, wherein said gas is an inert gas.

8. A foam casting method according to claim 3, wherein the melt contains at least one metal selected from the group consisting of magnesium and aluminum.

9. A foam casting method according to claim 3, wherein a cavity in a component is filled by the foam casting method.

10. A foam casting method according claim 3, wherein multiple components are joined together in a non-interlocking manner by means of the foam casting method.

11. A foam casting method according to claim 3, wherein the gas causes foaming of the melt prior to solidification.

12. A foam casting method according to claim 3, wherein the metal foam completely fills up the mold cavity.

* * * * *